US012304696B2

(12) United States Patent
Parekh et al.

(10) Patent No.: US 12,304,696 B2
(45) Date of Patent: May 20, 2025

(54) WATER BOTTLE

(71) Applicant: HYDROS BOTTLE, LLC, San Francisco, CA (US)

(72) Inventors: Jay Kiran Parekh, Philadelphia, PA (US); Aakash Mathur, Philadelphia, PA (US); Joseph Jackson, Wilmington, DE (US); Ian White, Philadelphia, PA (US); David Fowlkes, West Chester, PA (US); Ian McDermott, Lincoln University, PA (US)

(73) Assignee: HYDROS BOTTLE, LLC, San Francisco, CA (US)

( * ) Notice: Subject to any disclaimer, the term of this patent is extended or adjusted under 35 U.S.C. 154(b) by 0 days.

(21) Appl. No.: 18/061,343

(22) Filed: Dec. 2, 2022

(65) Prior Publication Data

US 2023/0348146 A1 Nov. 2, 2023

Related U.S. Application Data

(63) Continuation of application No. 16/170,846, filed on Oct. 25, 2018, now Pat. No. 11,518,581, which is a (Continued)

(51) Int. Cl.
*B65D 41/04* (2006.01)
*A45F 3/16* (2006.01)

(Continued)

(52) U.S. Cl.
CPC ..... *B65D 41/04* (2013.01); *A45F 3/16* (2013.01); *B65D 47/265* (2013.01); *B65D 47/32* (2013.01); *A45F 2003/163* (2013.01)

(58) Field of Classification Search
CPC ..... B65D 41/04; B65D 47/265; B65D 47/32; A45F 3/16; A45F 2003/163

(Continued)

(56) References Cited

U.S. PATENT DOCUMENTS 2,224,577 A 12/1940 Shively et al.
3,335,917 A 8/1967 Knight (Continued)

FOREIGN PATENT DOCUMENTS

CA 982779 A 2/1976
CN 202760835 U 3/2013

(Continued)

OTHER PUBLICATIONS

BPA-Free Water Bottles dated 2010, found online [Apr. 25, 2014] http://www.greendeals.org/bpa-free-water-bottles.

(Continued)

*Primary Examiner* — Ernesto A Grano
(74) *Attorney, Agent, or Firm* — Knobbe, Martens, Olson & Bear, LLP

(57) ABSTRACT

A portable, personal apparatus for transporting liquid having a bottle configured to contain liquid. The bottle has a longitudinal axis. A first opening open in a direction generally parallel with the longitudinal axis in a pour position. A first cover coupled to the bottle and configured to close the first opening in a closed position. A second opening open in a direction generally orthogonal with the longitudinal axis in a fill position. A second cover coupled to the bottle and configured to close the second opening in a storage position. The second cover remaining coupled to the bottle when the second cover is in the fill position.

19 Claims, 8 Drawing Sheets

Related U.S. Application Data continuation of application No. 15/906,690, filed on Feb. 27, 2018, now abandoned, which is a continuation of application No. 15/654,462, filed on Jul. 19, 2017, which is a continuation of application No. 14/346,250, filed as application No. PCT/US2012/056642 on Sep. 21, 2012, now Pat. No. 9,745,105.

(60) Provisional application No. 61/537,575, filed on Sep. 21, 2011.

(51) Int. Cl.
*B65D 47/26* (2006.01)
*B65D 47/32* (2006.01)

(58) Field of Classification Search
USPC ..... 215/228
See application file for complete search history.

(56) References Cited

U.S. PATENT DOCUMENTS 3,420,611 A 1/1969 Towns
D235,206 S 5/1975 Bertrand
D242,043 S 10/1976 Corder et al.
4,369,901 A 1/1983 Hidding
4,419,235 A 12/1983 Sway
4,585,151 A 4/1986 Luker
4,605,499 A 8/1986 Wise
D285,958 S 9/1986 Koizumi et al.
D289,914 S 5/1987 Willinger et al.
4,695,379 A 9/1987 Nohren, Jr. et al.
4,717,050 A 1/1988 Wright
4,732,303 A 3/1988 Wang
4,764,274 A 8/1988 Miller
4,769,144 A 9/1988 Nohren, Jr.
4,782,985 A 11/1988 Kinsley
D313,266 S 12/1990 Geneve et al.
4,986,901 A 1/1991 Nohren, Jr. et al.
5,002,665 A 3/1991 Brueggemann
5,130,020 A * 7/1992 Meckstroth ..... C02F 1/003 206/216
5,143,261 A 9/1992 Drobish
5,215,660 A 6/1993 Mosher
D338,946 S 8/1993 Taylor et al.
5,238,140 A 8/1993 Maze
5,242,079 A 9/1993 Stephens et al.
5,244,113 A 9/1993 Stymiest
5,303,850 A 4/1994 Connan
5,368,739 A 11/1994 Dussert et al.
D354,198 S 1/1995 Chiang et al.
5,393,548 A 2/1995 Heiligman
5,415,312 A 5/1995 Mueller
5,431,813 A 7/1995 Daniels
5,477,994 A 12/1995 Feer et al.
5,609,759 A * 3/1997 Nohren, Jr. ..... C02F 1/003 210/266
5,615,809 A 4/1997 Feer et al.
5,635,063 A 6/1997 Rajan et al.
5,653,878 A 8/1997 Reid
D383,192 S 9/1997 Johnson
5,681,463 A 10/1997 Shimizu et al.
5,688,397 A 11/1997 Malmborg
5,797,521 A 8/1998 Sobral
5,836,364 A 11/1998 Burton
5,840,185 A 11/1998 Hughes et al.
5,914,045 A 6/1999 Palmer et al.
5,919,365 A * 7/1999 Collette ..... A45F 3/20 210/419
5,928,512 A 7/1999 Hatch et al.
5,960,999 A 10/1999 Wallays
6,004,460 A * 12/1999 Palmer ..... C02F 1/003 210/209
6,136,188 A 10/2000 Rajan et al.
6,136,189 A 10/2000 Smith et al.
6,165,362 A 12/2000 Nohren, Jr. et al.
6,193,886 B1 2/2001 Nohren, Jr.
6,200,483 B1 3/2001 Cutler et al.
6,277,284 B1 8/2001 Nohren
6,382,476 B1 5/2002 Randall et al.
6,395,170 B1 5/2002 Hughes et al.
6,405,875 B1 6/2002 Cutler
6,468,435 B1 10/2002 Hughes et al.
6,524,477 B1 2/2003 Hughes
6,565,743 B1 5/2003 Poirier et al.
6,569,329 B1 * 5/2003 Nohren, Jr. ..... B01D 29/15 210/282
D477,382 S 7/2003 Strand
6,619,493 B2 9/2003 Yang
6,631,744 B1 10/2003 Gerhart et al.
6,733,669 B1 * 5/2004 Crick ..... C02F 1/003 210/244
6,783,019 B2 8/2004 Zettle et al.
D505,831 S 6/2005 Liu
6,945,289 B2 9/2005 Marszalec et al.
D510,235 S 10/2005 Sorensen
D513,304 S 12/2005 Suzuki
D518,555 S 4/2006 De Muro, Jr.
7,131,550 B2 11/2006 Vilalta et al.
D541,374 S 4/2007 Colussi et al.
7,255,241 B2 8/2007 Yoneoka et al.
7,396,461 B2 7/2008 Bommi et al.
D580,765 S 11/2008 Amann
D584,107 S 1/2009 George
7,473,362 B1 1/2009 Nohren, Jr.
D592,729 S 5/2009 Born et al.
D596,703 S 7/2009 McKinney et al.
D596,704 S 7/2009 Born et al.
D598,234 S 8/2009 Bodum
7,585,409 B2 * 9/2009 Bommi ..... B01D 21/0012 210/120
7,690,524 B2 4/2010 Chau
7,713,483 B2 * 5/2010 Maiden ..... B01D 29/085 422/64
7,754,898 B2 7/2010 Kobayashi et al.
D623,017 S 9/2010 George
7,798,346 B2 9/2010 Nelson et al.
D627,600 S 11/2010 Eyal
D631,285 S * 1/2011 Smiedt ..... C02F 1/003 D7/392.1
7,913,869 B2 3/2011 Cuocolo, Jr.
7,931,166 B2 4/2011 Cuocolo, Jr.
D640,084 S 6/2011 Sheppard et al.
7,975,883 B2 7/2011 Laib et al.
D642,852 S 8/2011 Sheppard et al.
D642,916 S 8/2011 Handy
7,993,518 B2 * 8/2011 Shani ..... B01D 61/18 210/236
8,025,802 B2 9/2011 Walde et al.
8,043,502 B2 10/2011 Nauta
D647,760 S 11/2011 Pearson
D649,402 S 11/2011 Gilbert et al.
D650,235 S 12/2011 Eyal
8,097,159 B1 1/2012 Peng
8,113,359 B2 2/2012 Perryman
8,142,654 B2 3/2012 Kohl
D656,787 S 4/2012 Phillips et al.
D658,064 S 4/2012 Barnes et al.
8,167,141 B2 5/2012 Knipmeyer et al.
D662,776 S 7/2012 Eyal
D664,002 S 7/2012 Eyal
8,216,465 B2 7/2012 Nauta
8,245,870 B2 8/2012 McKinney et al.
8,276,776 B2 10/2012 Roth et al.
8,277,666 B2 10/2012 Sturgess
8,337,697 B2 12/2012 Risheq
D674,463 S 1/2013 Wilder et al.
D674,464 S 1/2013 Wilder et al.
8,388,841 B2 3/2013 Moretto
8,425,771 B2 * 4/2013 O'Brien ..... C02F 1/002 210/200
8,439,205 B1 5/2013 Nohren, Jr.
8,454,826 B2 6/2013 Donnelly et al.
8,459,510 B2 6/2013 Richards et al.

(56) References Cited

U.S. PATENT DOCUMENTS

| | | | |
|---|---|---|---|
| D686,885 | S | 7/2013 | Meyers et al. |
| D686,886 | S | 7/2013 | Meyers et al. |
| D690,161 | S | 9/2013 | Garner |
| 8,541,039 | B2 | 9/2013 | Lackey et al. |
| 8,579,133 | B2 | 11/2013 | Marcus et al. |
| D694,852 | S | 12/2013 | Gordon |
| D696,079 | S | 12/2013 | Meyers et al. |
| 8,597,512 | B2 | 12/2013 | Sturgess |
| D696,892 | S | 1/2014 | Bretillot |
| D697,798 | S | 1/2014 | Sorensen et al. |
| 8,668,106 | B1 | 3/2014 | Joy et al. |
| 8,672,174 | B1 | 3/2014 | McMullin |
| 8,757,452 | B2 | 6/2014 | Richards et al. |
| 8,758,605 | B2 | 6/2014 | Risheq |
| D708,954 | S | 7/2014 | Barnes et al. |
| 8,778,244 | B2 | 7/2014 | Rusinov et al. |
| 8,794,469 | B2 | 8/2014 | Bratsch |
| 8,827,099 | B2 | 9/2014 | Joy et al. |
| 8,845,895 | B1 | 9/2014 | Ghiassi |
| 8,926,840 | B2 | 1/2015 | Hull et al. |
| 8,960,506 | B2 | 2/2015 | Beilke et al. |
| 8,978,923 | B2 | 3/2015 | George |
| D726,475 | S | 4/2015 | Wittke et al. |
| D727,680 | S | 4/2015 | Parekh et al. |
| D727,682 | S | 4/2015 | Madvin |
| 9,004,292 | B2 | 4/2015 | Carter et al. |
| D729,579 | S | 5/2015 | Molayem |
| 9,045,353 | B2 | 6/2015 | Parekh et al. |
| D734,638 | S | 7/2015 | Wahl |
| D747,936 | S | 1/2016 | Chitayat et al. |
| D754,999 | S | 5/2016 | Gamelli |
| D761,608 | S | 7/2016 | Gamelli et al. |
| D763,086 | S | 8/2016 | Kalagher |
| D766,652 | S | 9/2016 | Joseph et al. |
| D767,336 | S | 9/2016 | Waggoner et al. |
| D767,930 | S | 10/2016 | Gamelli et al. |
| D769,043 | S | 10/2016 | Gamelli et al. |
| D772,022 | S | 11/2016 | Cornu et al. |
| D776,483 | S | 1/2017 | Chitayat et al. |
| D778,095 | S | 2/2017 | Gamelli et al. |
| D788,529 | S | 6/2017 | Chitayat et al. |
| 9,745,105 | B2 | 8/2017 | Parekh et al. |
| D798,110 | S | 9/2017 | Valenti et al. |
| D801,184 | S | 10/2017 | Trevino |
| D877,565 | S | 3/2020 | Pehar et al. |
| 11,465,914 | B2 | 10/2022 | Pehar et al. |
| 11,518,581 | B2 | 12/2022 | Parekh et al. |
| 2001/0035428 | A1 | 11/2001 | Shipilevsky |
| 2002/0036207 | A1 | 3/2002 | Ohuo et al. |
| 2002/0088745 | A1 | 7/2002 | Barlow |
| 2003/0102313 | A1 | 6/2003 | Weber |
| 2003/0111495 | A1 | 6/2003 | Parve et al. |
| 2004/0118770 | A1 | 6/2004 | Sale et al. |
| 2004/0182860 | A1 | 9/2004 | Wu et al. |
| 2006/0000763 | A1 | 1/2006 | Rinker et al. |
| 2006/0043091 | A1 | 3/2006 | Pinelli et al. |
| 2006/0163136 | A1 | 7/2006 | Patil et al. |
| 2006/0201949 | A1 | 9/2006 | Byrd et al. |
| 2007/0102332 | A1 | 5/2007 | Bommi et al. |
| 2007/0119772 | A1 | 5/2007 | Hiranaga et al. |
| 2007/0151993 | A1 | 7/2007 | Yelland |
| 2008/0110820 | A1 | 5/2008 | Knipmeyer et al. |
| 2008/0135489 | A1 | 6/2008 | Saaski |
| 2008/0203007 | A1 | 8/2008 | Jang et al. |
| 2008/0223797 | A1 | 9/2008 | Reid et al. |
| 2009/0026218 | A1 | 1/2009 | Wong et al. |
| 2009/0057220 | A1 | 3/2009 | Nauta |
| 2009/0101617 | A1 | 4/2009 | Viggiano |
| 2009/0155436 | A1 | 6/2009 | Chalmers et al. |
| 2009/0188884 | A1 | 7/2009 | Nelson et al. |
| 2009/0218357 | A1 | 9/2009 | Byrd et al. |
| 2010/0219151 | A1 | 9/2010 | Risheq |
| 2010/0230345 | A1 | 9/2010 | Chen |
| 2011/0117257 | A1* | 5/2011 | Sturgess ..... C02F 1/002 426/398 |
| 2011/0217544 | A1 | 9/2011 | Young et al. |
| 2011/0303618 | A1 | 12/2011 | Cueman et al. |
| 2012/0055862 | A1 | 3/2012 | Parekh et al. |
| 2012/0074091 | A1 | 3/2012 | Himelstein |
| 2012/0148707 | A1 | 6/2012 | Lackey et al. |
| 2012/0187036 | A1 | 7/2012 | Risheq |
| 2012/0255890 | A1 | 10/2012 | Cumberland |
| 2012/0285961 | A1 | 11/2012 | Roth et al. |
| 2012/0298614 | A1* | 11/2012 | Nelson ..... B65D 51/24 215/308 |
| 2012/0305559 | A1 | 12/2012 | Steininger |
| 2013/0001143 | A1 | 1/2013 | Nelson |
| 2013/0032566 | A1 | 2/2013 | Lee |
| 2013/0153480 | A1 | 6/2013 | Risheq |
| 2013/0233178 | A1 | 9/2013 | Herling et al. |
| 2013/0233869 | A1 | 9/2013 | Tamarit Rios |
| 2014/0014571 | A1 | 1/2014 | Nelson et al. |
| 2014/0048549 | A1 | 2/2014 | Wille |
| 2014/0069917 | A1 | 3/2014 | Meyers et al. |
| 2014/0069946 | A1 | 3/2014 | Gubitosi et al. |
| 2014/0078857 | A1 | 3/2014 | Nelson et al. |
| 2014/0083924 | A1 | 3/2014 | Bergendal et al. |
| 2014/0124458 | A1 | 5/2014 | Sturgess |
| 2014/0144828 | A1 | 5/2014 | Chiu |
| 2014/0174965 | A1 | 6/2014 | Herling et al. |
| 2014/0216959 | A1 | 8/2014 | Raymus et al. |
| 2014/0217056 | A1 | 8/2014 | Parekh et al. |
| 2014/0263476 | A1 | 9/2014 | Blain et al. |
| 2015/0014252 | A1 | 1/2015 | Justus, Sr. |
| 2015/0060495 | A1 | 3/2015 | Steinway |
| 2015/0122710 | A1 | 5/2015 | Hull et al. |
| 2015/0122725 | A1 | 5/2015 | Del Ponte et al. |
| 2015/0166364 | A1 | 6/2015 | Wiegele |
| 2015/0250341 | A1 | 9/2015 | Liu et al. |
| 2016/0107898 | A1 | 4/2016 | Parekh et al. |
| 2018/0273398 | A1 | 9/2018 | Pehar et al. |
| 2019/0382282 | A1 | 12/2019 | Parekh et al. |
| 2020/0095029 | A1 | 3/2020 | Pehar et al. |
| 2022/0234911 | A1 | 7/2022 | Parekh et al. |
| 2023/0312371 | A1 | 10/2023 | Pehar et al. |

FOREIGN PATENT DOCUMENTS

| | | | |
|---|---|---|---|
| EP | 0 345 381 | A2 | 12/1989 |
| EP | 2 828 203 | B1 | 6/2018 |
| JP | S49-1281 | U | 1/1974 |
| JP | H4-6052 | A | 1/1992 |
| JP | 3045003 | B2 | 5/2000 |
| JP | 2009-169119 | A | 7/2009 |
| JP | 2013-116752 | A | 6/2013 |
| WO | WO 2008/026208 | A2 | 3/2008 |
| WO | WO 2008/036861 | A2 | 3/2008 |
| WO | WO 2008/150867 | | 12/2008 |
| WO | WO 2010/022353 | | 2/2010 |
| WO | WO 2015/139846 | A1 | 9/2015 |
| WO | WO 2016/117850 | A1 | 7/2016 |
| WO | WO 2017/053588 | | 3/2017 |

OTHER PUBLICATIONS

Extended European Search Report dated May 10, 2019, for European Application No. 16849609.9, 9 pages.

Hydros 4 Bottle Family Gift Pack dated 2011. found online [Apr. 25, 2011] http://www.hydrosbottle.com/shop/hydros-6pack htmi.

Hydros Bottle on amazon dated Oct. 27, 2010, found online [Apr. 25, 2017], https://www.amazon.com/Hydros-Bottle-Filtering-Social-Mission/dp/B003QJ31JO.

Hydros Filtering Water Bottles dated Sep. 19, 2011 found online [Apr. 26, 2015] http://www.onlineprnews.com/news/169792-1316453211-hydros-filtering-water-bottles-show-how-sustainability-is-sexy-at-natural -products-expo-east.html.

International Preliminary Report on Patentability mailed Oct. 3, 2019 in International Application No. PCT/US2018/023854, 9 pages.

International Search Report dated Jan. 22, 2013 from International Application No. PCT/US2012/056642 filed Sep. 21, 2012 in 2 pages.

(56) References Cited

OTHER PUBLICATIONS

International Search Report dated Feb. 7, 2017 from International Application No. PCT/US2016/053147 filed Sep. 22, 2016 in 22 pages.
International Search Report dated Jul. 12, 2018 from International Application No. PCT/US2018/023854 filed Mar. 22, 2018 in 25 pages.
U.S. Appl. No. 61/126,589, filed May 6, 2008 by Mittal.
U.S. Appl. No. 61/189,540, filed Aug. 21, 2008 by Mittal.
U.S. Appl. No. 61/203,661, filed Dec. 26, 2008 by Mittal.
Ubergizmo, "Binibottle design is revolutionary," Oct. 10, 2007, p. 1 [online] <URL: http://www.ubergizmo.com/2007/10/binibottle-design-is-revolutionary/> [retrieved Dec. 23, 2014].
Website: 3-2-1 water (www.321-water.com) accessed on Sep. 2, 2011.
Website: Aquamira (www.aquamira.com) accessed on Sep. 2, 2011.
Website: Clear20 (www.clear2o.com) accessed on Sep. 2, 2011.
Website: Enviro Products (www.newwaveenviro.com) accessed on Sep. 2, 2011.
Website: Fit & Fresh Livpure Bottle (www.fit-fresh.com/products/livpure) accessed on Sep. 2, 2011.
Website: Guyot Tapguard (www.guyotdesigns.com) accessed on Sep. 2, 2011.
Website: Pure Hydration Aquapure Travel (www.bwtechnologies.com/aquapure_traveller.html) accessed on Sep. 2, 2011.
Website: Seychelle (www.seychelle.com) accessed on Sep. 2, 2011.
Website: Water Bobble (www.waterbobble.com) accessed on Sep. 2, 2011.

* cited by examiner

WATER BOTTLE

CROSS-REFERENCE TO RELATED APPLICATIONS

This application claims the benefit of U.S. Provisional Patent Application No. 61/537,575 filed Sep. 21, 2011 entitled "Side-fill Bottle Cap", incorporated by reference herein in its entirety.

BACKGROUND OF THE INVENTION

The present invention generally relates to a water bottle.

BRIEF SUMMARY OF THE INVENTION

In one embodiment, there is a portable, personal apparatus for transporting liquid comprising: a bottle configured to contain liquid, the bottle having a longitudinal axis; a first opening open in a direction generally parallel with the longitudinal axis in a pour position; a first cover coupled to the bottle and configured to close the first opening in a closed position; a second opening open in a direction generally orthogonal with the longitudinal axis in a fill position; and a second cover coupled to the bottle and configured to close the second opening in a storage position, the second cover remaining coupled to the bottle when the second cover is in the fill position. In one embodiment, the bottle has a closed bottom and an open top, the water bottle further comprising: a cap coupled to the open top of the bottle, the cap including the first opening and the second opening.

In a further embodiment the apparatus comprises a filter coupled to the cap and extending into the bottle. In one embodiment, the cap includes a fluid reservoir between the second opening and the filter. In one embodiment, the first opening is only in fluid communication with the fluid reservoir in the storage position through the filter. In one embodiment, the filter includes a closed bottom surface, the bottom surface being at an oblique angle with respect to the longitudinal axis. In one embodiment, the first opening is spaced from the longitudinal axis in a first direction and wherein the filter is closed except for a top surface and at least one opening that faces in a second direction generally opposite the first direction. In one embodiment, the filter is configured to reduce at least one contaminant conforming to the NSF/ANSI 42 standard at a given flow rate of approximately 1.9 Lpm to approximately 2.3 Lpm while filling the bottle through the second opening. In one embodiment, an inlet of the filter is generally orthogonal to an outlet of the filter.

In one embodiment, the cap includes a sidewall and an open top, the second opening extends through the sidewall and the first cover is coupled to the open top of the cap. In one embodiment, the second cover is a collar having a window, the collar extending around the sidewall of the cap and configured to be selectively rotated with respect to the cap about the longitudinal axis, the window aligning with the second opening in the fill position. In one embodiment, the cap is threadably coupled to the bottle. In a further embodiment the apparatus comprises a third opening configured to allow ambient air into the bottle when liquid is poured from the first opening. In one embodiment, the third opening is closed when the first cover is in the closed position. In one embodiment, the first opening is spaced from the longitudinal axis and is generally diametrically opposed to the second opening with respect to the longitudinal axis. In one embodiment, the second cover is a collar configured to be selectively rotated about the longitudinal axis. In one embodiment, the first cover is a top cap configured to be selectively rotated about the longitudinal axis. In one embodiment, the first cover remains coupled to the bottle when the first cover is in the pour position.

In another embodiment, there is a portable, personal apparatus for transporting liquid comprising: a bottle configured to contain liquid, the bottle having a closed bottom, an open top and a longitudinal axis extending between the closed bottom and open top; a cap coupled to the open top of the bottle and having a top, a bottom, a sidewall and a reservoir, the cap having a channel closed to the reservoir and open through the top and bottom of the cap and a opening extending through the sidewall of the cap and into the reservoir; a filter coupled to the bottom of the cap and extending into the bottle; a first cover coupled to the top of the cap and configured to be selectively operated to uncover the channel in a pour position and close the channel in a closed position; and a second cover coupled to the sidewall of the cap and configured to be selectively rotated about the longitudinal axis relative to the cap to uncover the opening in a fill position and close the opening in a storage position.

BRIEF DESCRIPTION OF THE SEVERAL VIEWS OF THE DRAWINGS

The foregoing summary, as well as the following detailed description of embodiments of the water bottle, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
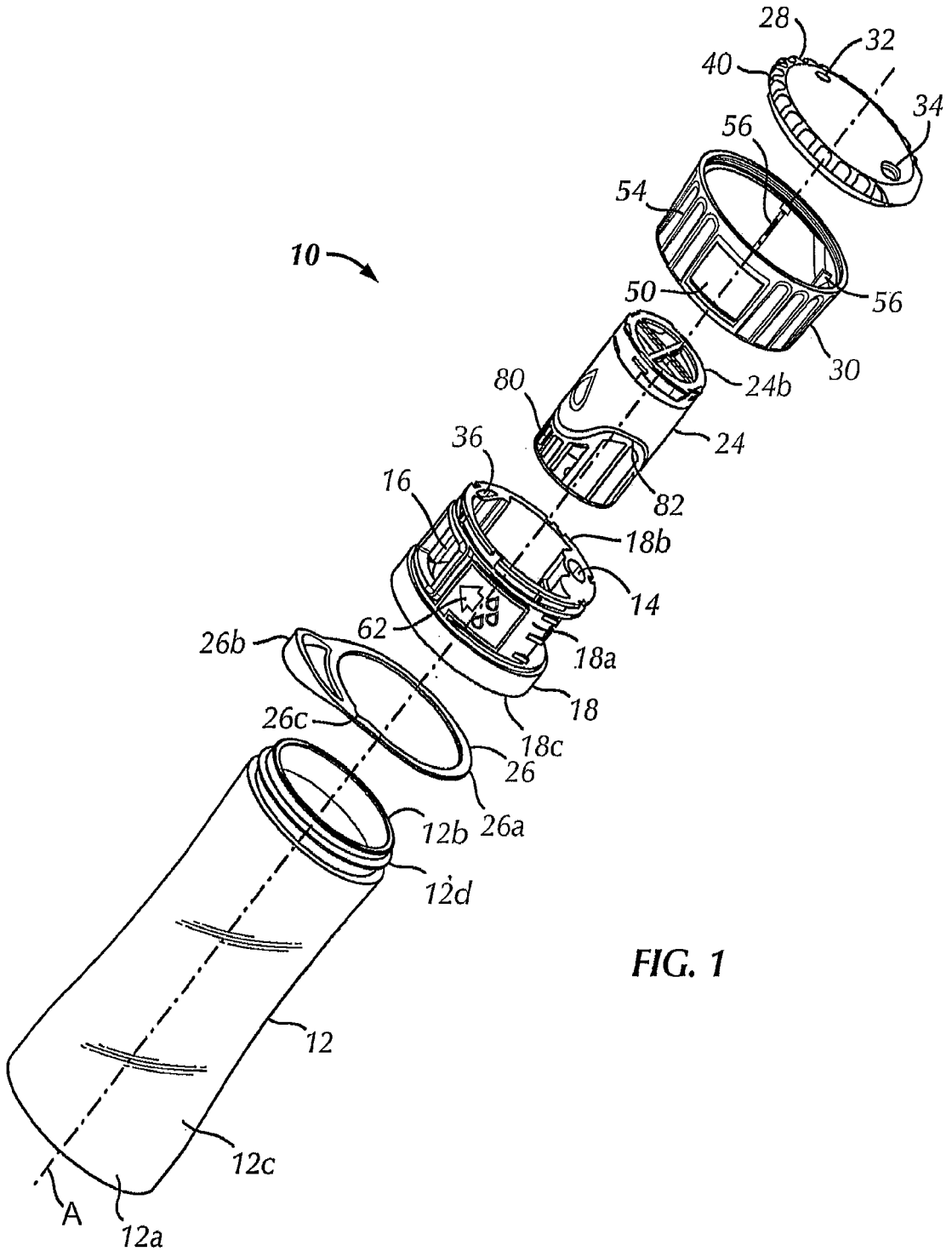
FIG. 1 is an exploded side perspective view of a water bottle in accordance with an exemplary embodiment of the present invention.
Figure 2A:
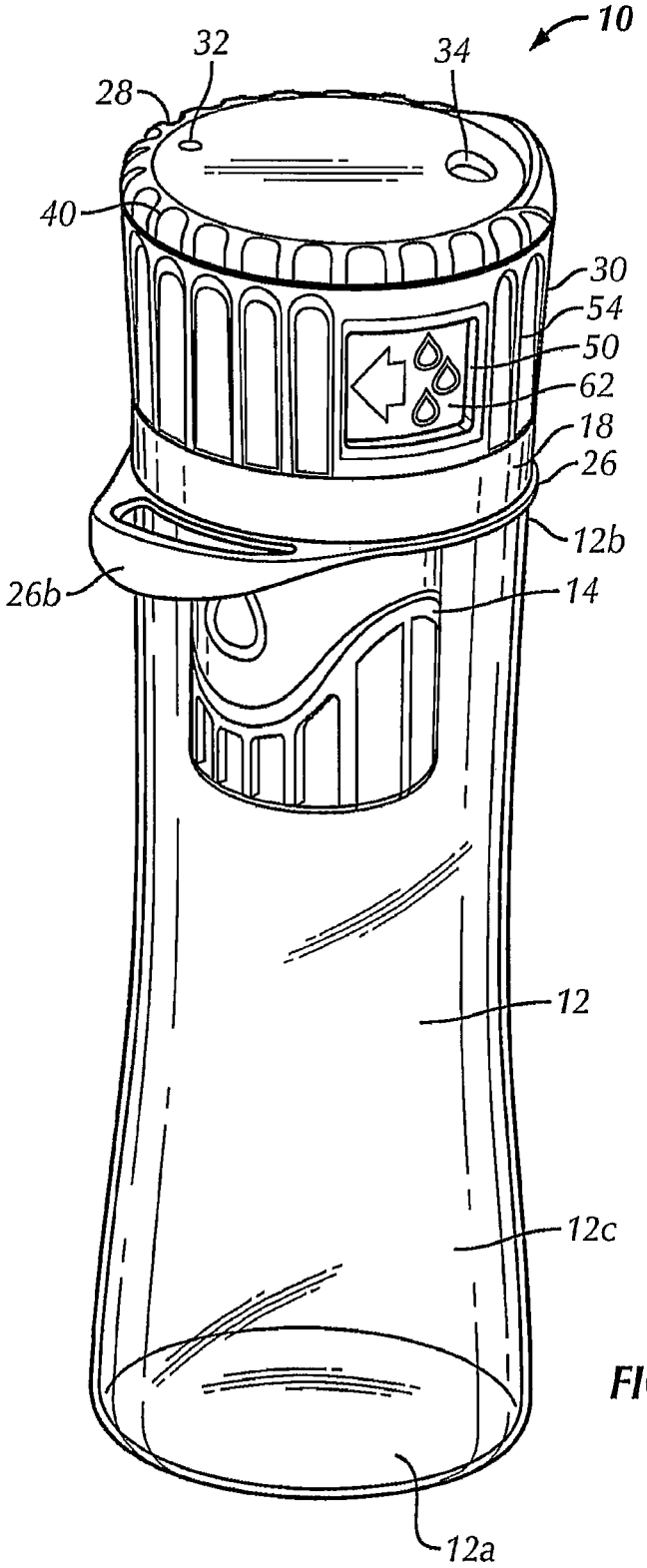
FIG. 2A is a perspective view of the water bottle shown in FIG. 1 in the closed and storage positions.
Figure 2B:
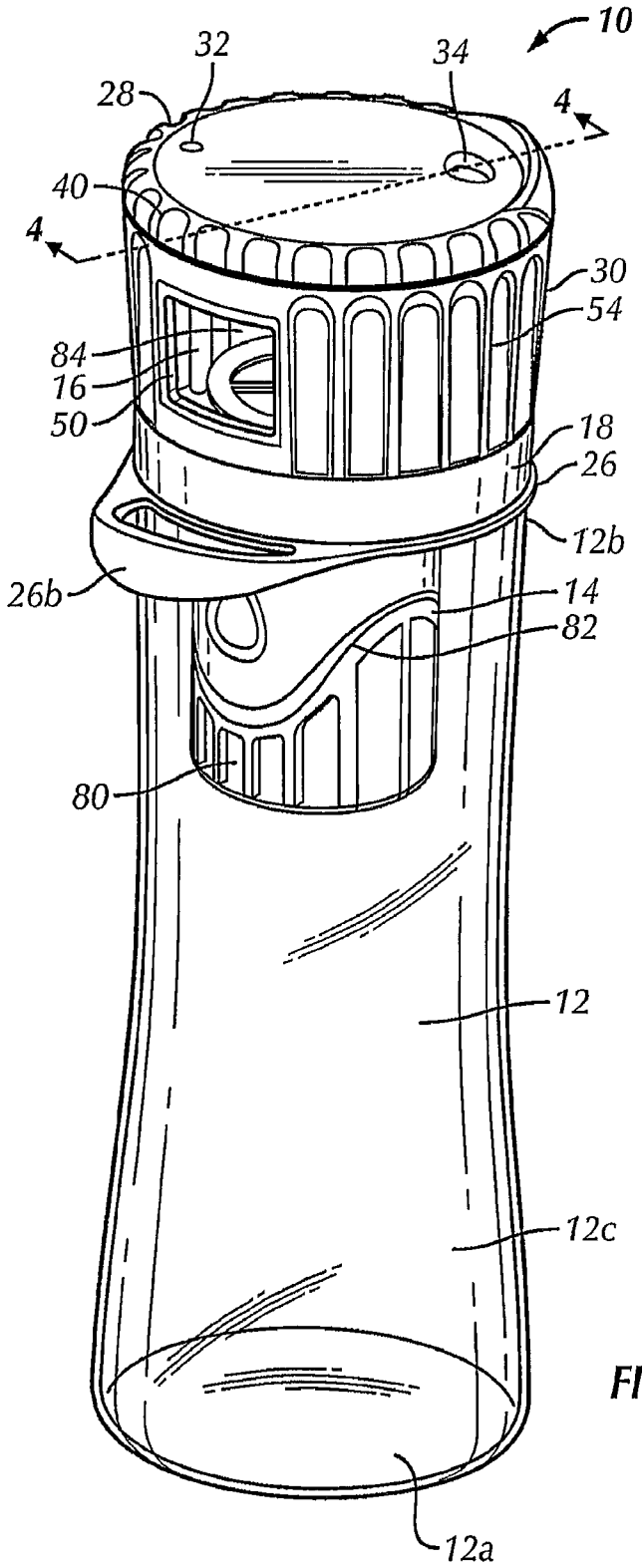
FIG. 2B is a perspective view of the water bottle shown in FIG. 1 in the closed and fill positions.

Reusable water bottles are used in daily life by people across the world to conveniently carry water. Millions of Americans carry reusable water bottles with them daily. They offer the convenience of bottled water without either the expense or the environmental damage. As more Americans become aware of the 60 million disposable water bottles that end up in landfills every single day, they increasingly look to reusable water bottles to provide an alternative. Existing reusable water bottles are poorly designed to be easily filled from existing tap water sources. For example, if you attempt to fill a bottle from a faucet with a shallow sink, you will be unable to fit the bottle under the flow of the water stream. Similarly, if you attempt to fill a bottle from a water fountain with a slow stream, the angle and bottle mouth geometry will only allow the bottle to partially fill, if at all.

As the environmental and economic cost of bottled water continues to increase and more and more people carry reusable water bottles, people are looking for an improved design to facilitate refilling from various tap water sources.

Existing reusable water bottles require a user to remove the cap and pour water directly into the mouth of the bottle in order to fill the bottle. This design does not allow for filling from shallow sinks or fountains, since the height of the bottle must clear the faucet before it can be filled. This design also requires detaching a cap and separately holding the cap or holding an attachment strap of the cap in such a way so as to avoid touching the cap with surrounding surfaces.

In some embodiments, the bottle cap of the present invention is configured to allow for filling from the side of the bottle in place of or in addition to filling from the top of the bottle. In a preferred, non-limiting embodiment, the reusable water bottle cap of the present invention comprises 1) a side-filling port sealed by a rotating collar and 2) a drink-port that allows for water to exit the bottle without detaching a cap from the bottle.

Referring to the drawings in detail, wherein like reference numerals indicate like elements throughout, there is shown in FIGS. 1A-9 a portable, a personal apparatus for transporting liquid, generally designated 10 and also referred to as a water bottle, in accordance with an exemplary embodiment of the present invention.

In one embodiment, apparatus 10 is a reusable water bottle used to transport drinking water. In some embodiments, apparatus 10 is configured to filter water 20 while filling apparatus 10 with potable water 22 (see FIG. 3). However, apparatus 10 may be used for transporting any potable (e.g., flavored water created by adding water 20 to a powder or concentrate) or non-potable liquid (e.g., motor oil that may be leaking in a low clearance space) and need not necessarily include a filter. In one embodiment, apparatus 10 includes a first opening 14 to dispense liquid and a second opening 16 to receive liquid as discussed further below.

Referring to FIG. 1, apparatus 10 includes a bottle 12 having a bottom 12*a*, a top 12*b* and sidewall 12*c* extending between the top 12*b* and bottom 12*a* about a longitudinal axis A. In one embodiment, sidewall 12*c* is shaped and configured to be held in a single hand of an adult. In one embodiment, sidewall 12*c* is generally cylindrical. In one embodiment, sidewall 12*c* is generally cylindrical proximate top 12*b* and flares out toward and proximate bottom 12*a*. In one embodiment, a flared sidewall 12*c* proximate bottom 12*a* allows for the middle section of bottle 12 to have a smaller diameter for grasping by a user while having a larger bottom 12*a*. In one embodiment, a larger bottom 12*a* allows for bottle 12 to hold more liquid and have a more stable base when placed on a generally horizontal surface. In other embodiments, sidewall 12*c* is cylindrical from top 12*b* to bottom 12*a*, rectangular, curved, indented or has any other preferred shaped and features.

In one embodiment, bottom 12*a* is closed and top 12*b* is configured to receive and dispense the liquid from bottle 12. In other embodiments, bottom 12*a* and/or top 12*b* is configured to receive and dispense the liquid from bottle 12. In one embodiment, top 12*b* is open. In one embodiment, top 12*b* is configured to be closed by a cap 18. In one embodiment, top 12*b* is configured to be closed by cap 18 and one or more covers coupled to cap 18. In one embodiment, cap 18 is configured to be removed from bottle 12 in order to clean bottle 12. In one embodiment, cap 18 is configured to be removed from bottle 12 in order to replace a filter 24 described in further detail below. In one embodiment, cap 18 is threadably coupled to top 12*b* by threads 12*d*. In other embodiments, cap 18 is attached to bottle in any preferred way such as friction fit, snap fit and fixably fit.

In one embodiment, bottle 12 is generally rigid. In other embodiments, bottle 12 is flexible to allow liquid to be squeezed from bottle 12. In one embodiment, bottle 12 is comprised of a polymer. In one embodiment, bottle 12 is comprised of Eastman's Tritan®, a copolyester. In other embodiments, bottle 12 is comprised of any suitable material such as polycarbonate, a biodegradable polylactic acid, polypropylene, polyethylene, glass or metal such as stainless steam. In one embodiment, bottle 12 is free of Bisphenol A (BPA).

With continued reference to FIG. 1, apparatus 10, in one embodiment, includes a carrying loop 26. In one embodiment, carrying loop 26 is configured to attach apparatus 10 to a clip such as a carabineer or strap or allow a user to carry apparatus 10 using one or two fingers. In one embodiment, carrying loop 26 includes a first loop 26*a* and a second loop 26*b*. In one embodiment, first loop 26*a* is configured to attach to top 12*b* of bottle 12. In one embodiment, first loop 26 is configured to be sandwiched between cap 18 and bottle 12. In one embodiment, first loop 26 is configured and sized to pass over threads 12*d* of bottle 12. In one embodiment, first loop 26 stretches in order to fit over threads 12*d*. In one embodiment, first loop 26 includes a notch 26*c*. In one embodiment, notch 26*c* is configured to engage threads 12*d* and allow for carrying loop 26 to be screwed onto and off of bottle 12. In one embodiment, carrying loop 26 is comprised of a polymer. In one embodiment, carrying loop 26 is comprised of Santoprene®, a thermoplastic elastomer (TPE). In other embodiments, carrying loop 26 is comprised of any suitable material such as other TPEs, polypropylene, or polyethylene.

In one embodiment, second loop 26*b* is thicker than first loop 26*a*. In one embodiment, once coupled to bottle 12, carrying loop 26 is configured to rotate with respect to bottle 12 about longitudinal axis A such that second loop 26*b* can be positioned at any desired radial position with respect to bottle 12. In other embodiments, carrying loop 26 is fixedly attached to or is integral with bottle 12 and/or cap 18. In another embodiment, carrying loop 26 is omitted.

Figure 5:
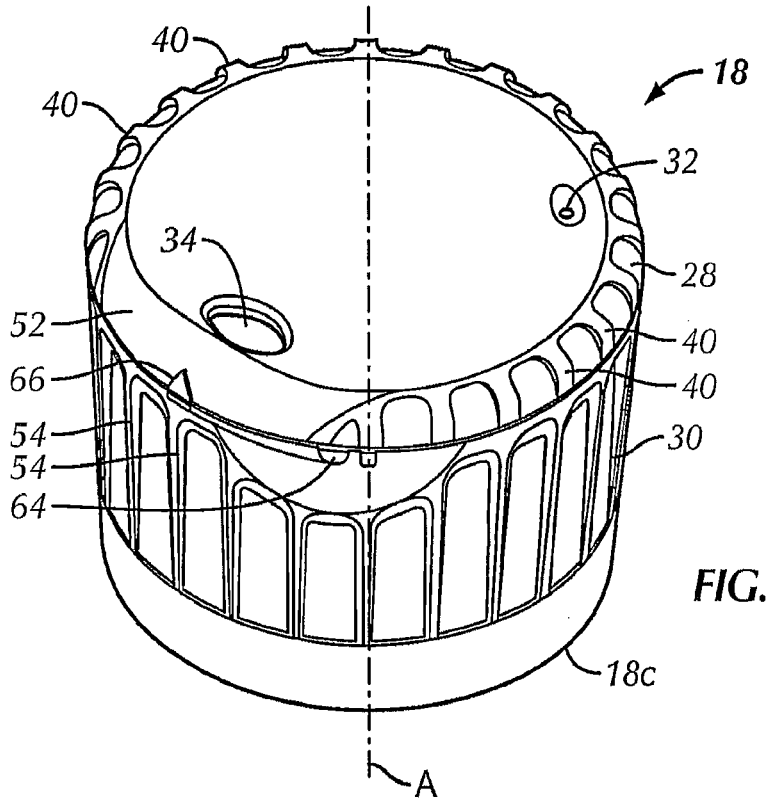
FIG. 5 is a top perspective view of a cap of the water bottle shown in FIG. 1 in the closed position.
Figure 6:
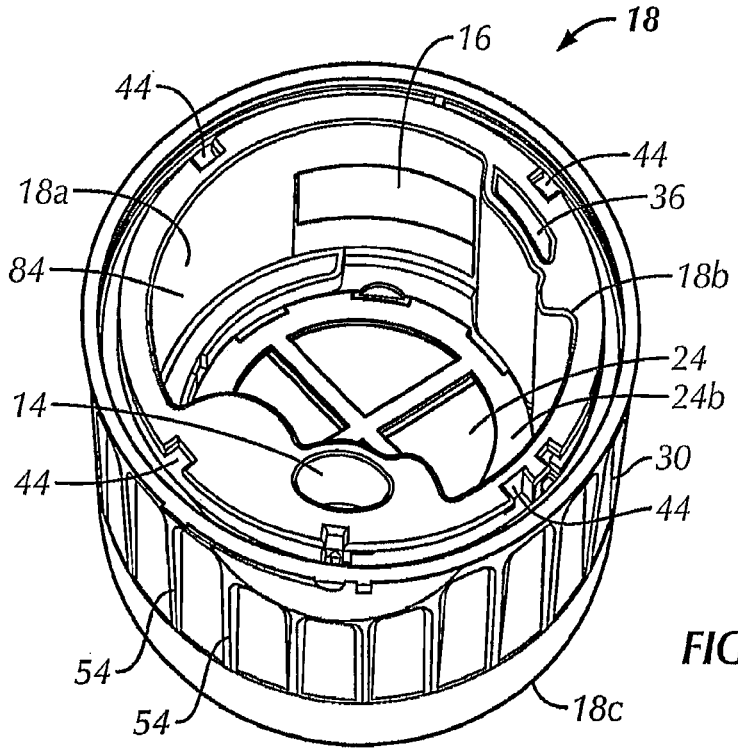
FIG. 6 is a top perspective view of a portion of the cap shown in FIG. 5 and a top of the filter.

Referring to FIGS. 1, 5 and 6, in one embodiment, cap 18 includes both first opening 14 and second opening 16. In one embodiment, first opening 14 and second opening 16 are proximate top 12*b* of bottle 12. In one embodiment, cap 18 includes a sidewall 18*a* and an open top 18*b*. In one embodiment, cap 18 includes a first cover 28 coupled to top 18*b*. In one embodiment, first cover 28 is coupled to bottle 12 and configured to close first opening 14 in a closed position. In one embodiment, first cover 28 is a top cap configured to be selectively rotated about longitudinal axis A. In one embodiment, first cover 28 is configured to selectively expose and cover first opening 14 when first cover 28 is rotated about longitudinal axis A. In one embodiment, first cover 28 includes a pour opening 34 configured to align with first opening 14 in a pour position. In one embodiment, first cover 28 includes a lip 52 proximate pour opening configured to contour to a user's lips while drinking. In one embodiment, lip 52 is generally smooth. In other embodiments, lip 52 may be configured to have a spout for pouring. In one embodiment, pour opening 34 includes a sport top. In one embodiment, first cover 28 includes a vent opening 32 configured to selectively expose and cover a vent 36 fluidly coupled with bottle 12. In one embodiment, vent opening 32 is configured to be aligned with vent 36 in the pour position.

Referring to FIG. 5, in one embodiment, first cover 28 includes a plurality of ribs 40. In one embodiment, ribs 40 are spaced around the periphery of first cover 28. In one embodiment, ribs 40 are configured to help a user to grip and twist first cover 28 relative to cap 18. In one embodiment, first cover 28 is comprised of two materials. In one embodiment, at least a portion of the periphery of first cover 28 is comprised of a material having a higher coefficient of friction than the remainder of first cover 28. In one embodiment, the periphery of first cover 28 is comprised of Sarlink®, a thermoplastic elastomer (TPE). In other embodiments, periphery of first cover 28 is comprised of any suitable material such as any TPE, polypropylene, or polyethylene. In one embodiment, the remainder of first cover 28 is comprised of polypropylene. In other embodiments, the remainder of first cover 28 is comprised of any suitable material such as polyethylene, polylactic acid, or polyurethane. In one embodiment, the periphery of first cover 28 is over molded onto the remainder of first cover 28.

Figure 7:
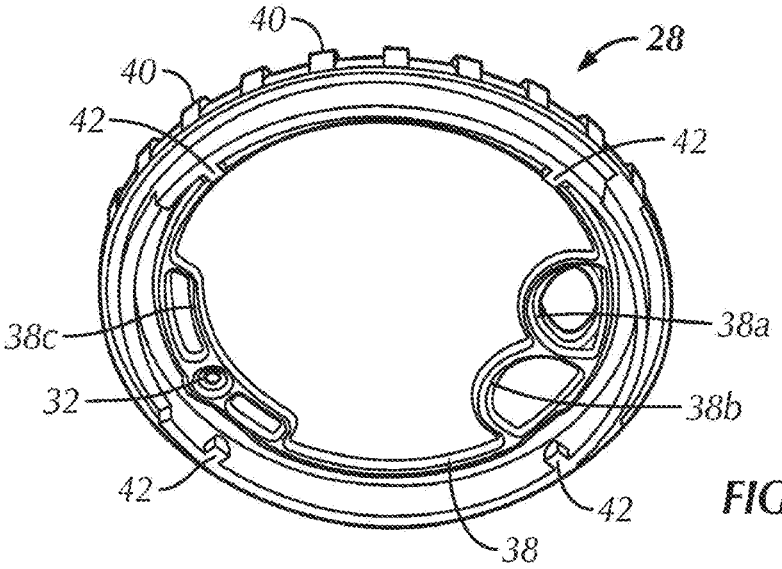
FIG. 7 is a bottom perspective view of a top cap of the water bottle shown in FIG. 1.
Figure 8:
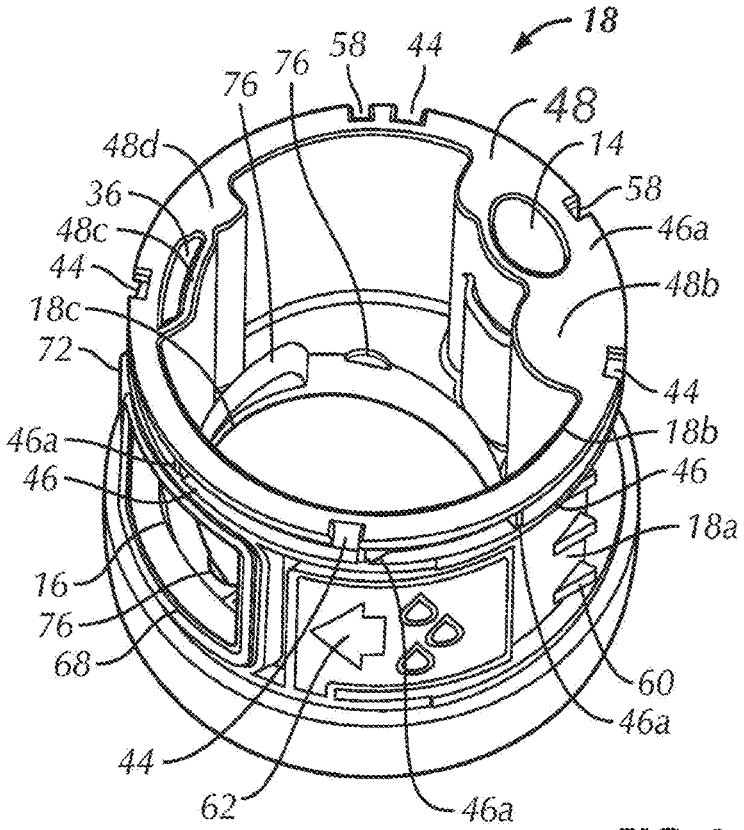
FIG. 8 is a top perspective view of a portion of a cap of the water bottle shown in FIG. 1.

Referring to FIGS. 7 and 8, in one embodiment, first cover 28 remains coupled to the bottle when first cover 28 is in the pour position. In one embodiment, first cover 28 is twisted a partial rotation about longitudinal axis A to open or expose first opening 14 and twisted back a partial rotation about longitudinal axis A to close and seal first opening 14 to prevent liquid from being poured from first opening 14. In one embodiment, first cover 28 is removable from cap 18. In one embodiment, bottle 12 can be filled by removing first cover 28 from cap 18. In one embodiment, filling bottle 12 by removing first cover 28, or an opening in first cover 28, allows for bottle 12 to be held generally vertical while filling if, for example, it is desired to keep bottle 12 vertical while filling, the water source has sufficient clearance for a vertical bottle 12 or first cover 28 is already removed. In one embodiment, first cover 38 is generally as wide as the opening of bottle 12. In one embodiment, first cover 28 is a generally circular. In other embodiments, first cover 38 is rectangle, triangular, oval or any other preferred shape.

In one embodiment, first cover 28 is removable from cap 18 in order to fill bottle 12, clean cap 18 and/or replace filter 24. In other embodiments, only a portion of first cover 28 moves relative to bottle 12 to expose and cover first opening 14 such as a hinged lid or a sliding or rotating door. In one embodiment, the bottom of first cover 28 includes one or more projections 42 proximate the periphery of first cover 28 and extending radially inwardly. In one embodiment, projections 42 are configured to be received into slots 44 of cap 18 in a removable or assembly position. In one embodiment, projections 42 are slideably received into tracks 46 of cap 18 between the pour and closed positions. In one embodiment, tracks 46 include one or two limit stops 46*a* to limit the amount and direction first cover 28 can be rotated relative to cap 18.

With continued reference to FIGS. 7 and 8, in one embodiment, the bottom surface of first cover 28 includes a cap seal 38. In on embodiment, cap seal 38 is comprised of an elastomeric material. In one embodiment, cap seal 38 is configured to engage a top surface [46] 48 of cap 18. In one embodiment, the size and shape of top surface 48 is configured to generally match the shape of seal 38 between the pour and closed positions. In one embodiment, cap seal 38 includes a first pour seal 38*a* that extends around the bottom periphery of pour opening 34. In one embodiment, first pour seal 38*a* forms a seal with a first area 48*a* of top surface 48 around first opening 14 between cap 18 and first cover 28 in the pour position. In one embodiment, cap seal 38 includes a second pour seal 38*b* proximate the first pour seal 38*a*. In one embodiment, second pour seal 38*b* forms a seal with a second area of top surface 48 between cap 18 and first cover 28 in the closed position. In one embodiment, cap seal 38 includes a vent seal 38*c* proximate vent opening 32. In one embodiment, vent seal 38*c* forms a seal with a third area 48*c* around vent 36 between cap 18 and first cover 28 in the pour position. In one embodiment, vent seal 38*c* forms a seal with a fourth area 48*d* proximate vent 36 between cap 18 and first cover 28 in the closed position. In other embodiments, cap seal 38 is provided on top surface 48 of cap 18.

In one embodiment, cap seal 38 only substantially projects from the bottom surface of first cover 28 to minimize the drag along top surface 46 of cap 18 when rotating first cover 28 open and closed relative to cap 18. In one embodiment, thinning the material on the bottom of first cover 28 improves the moldability. In some embodiments, the thicker sections of cap seal 38 require more resin, fill slower, and take longer to manufacture.

Figure 9:
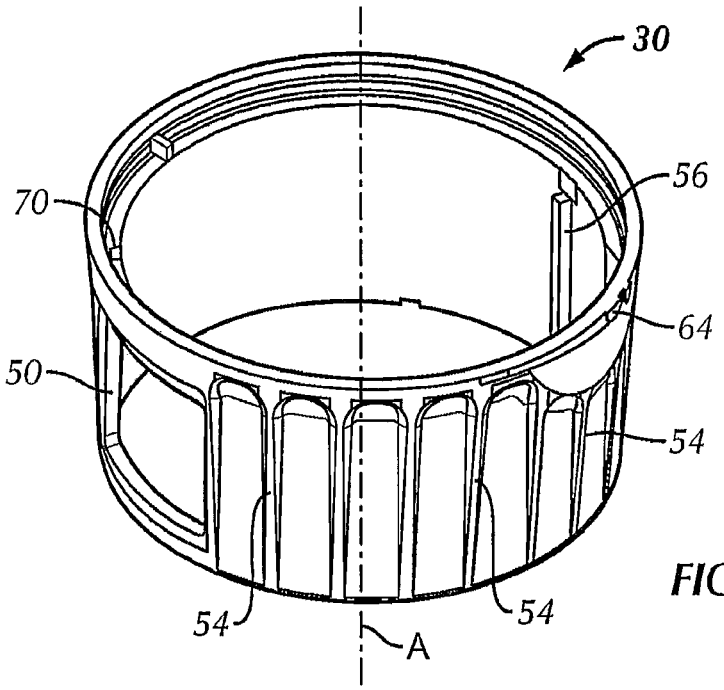
FIG. 9 is a top perspective view of a collar of the water bottle shown in FIG. 1.

Referring to FIGS. 6, 8 and 9, in one embodiment, cap 18 includes a second cover 30. In one embodiment, second cover 30 is coupled to bottle 12 and configured to close second opening 16 in a storage position (See FIG. 2A). In one embodiment, second cover 30 is configured to expose or open second opening 16 in a fill position (See FIGS. 2B and 3). In one embodiment, second cover 30 remains coupled to bottle 12 when second opening 16 is in the fill position. In one embodiment, second cover 30 is a collar configured to be selectively rotated about longitudinal axis A with respect to cap 18. In other embodiments, second opening 16 includes a plug or a hinged or sliding door. In one embodiment, second cover 30 is a generally cylindrical sleeve. In other embodiments, second cover 30 is rectangle, triangular, oval or any other preferred shape in cross section.

In one embodiment, second cover 30 includes an open window 50. In one embodiment, window 50 aligns with second opening 16 in the fill position. In one embodiment, window 50 is generally square. In other embodiments, window 50 and second opening 16 are circular, ovular, square or any other preferred shape. In one embodiment, window 50 is generally the same size and shape as second opening 16. In other embodiments, window 50 and second opening are different sizes and/or shapes as each other. In one embodiment, window 50 is approximately 2 cm tall and 2.5 cm wide.

Referring to FIG. 9, in one embodiment, second cover 30 includes a plurality of ribs 54. In one embodiment, ribs 54 are configured to help a user to grip and twist second cover 30 relative to cap 18. In one embodiment, at least a portion of second cover 30 is comprised of a material having a higher coefficient of friction than the remainder of second cover 30. In one embodiment, second cover 30 is comprised of acrylonitrile butadiene styrene. In other embodiments, second cover 30 is comprised of any suitable material such as copolyester, polycarbonate, or styrene-acrylonitrile.

Referring to FIGS. 8 and 9, in one embodiment, second cover 30 includes one or more projections 56. In one embodiment, projection 56 is configured to be received in groove 58 of cap 18. In one embodiment, projection 56 align with and can slide axially into and out of groove 58 in the storage position. In one embodiment, second cover 30 is configured to be removed from cap 18 in order to clean between cap 18 and second cover 30. In one embodiment, second cover 30 is fixedly coupled with cap 18 in the axial direction. In one embodiment, projection 56 snap fit into and out of groove 58 when second cover 30 is rotated relative to cap 18 to indicate when second opening 16 is in the fill or storage positions. In one embodiment, second cover 30 includes two projections 56 so that a projection 56 snap fits into groove 58 proximate first opening 14 in both the fill and storage positions. In one embodiment, cap 18 includes one or more stops projecting from sidewall 18*a* to limit the amount that second cover 30 rotates relative to cap 18. In one embodiment, a user can feel and/or hear when second cover 30 is moved into the fill or storage position without having to look at apparatus 10. In one embodiment, sidewall 18*c* of cap 18 includes indicia 62 visible through window 50 in the storage position. In one embodiment, indicia 62 includes graphics, text and/or color to indicate that apparatus 10 is in the storage position. In one embodiment, indicia 62 indicates how to move second cover 30 relative to cap 18 and into the fill position.

Referring to FIGS. 5 and 9, in one embodiment, second cover 30 includes indicia 64 and first cover 28 includes indicia 66 to indicate the position of first cover 28 relative to second cover 30. In one embodiment, indicia 64, 66 indicate when first cover 28 is in the pour and closed positions. In one embodiment, indicia 64, 66 indicate when first cover 28 is in the removable or assembly position.

Referring to FIG. 8, in one embodiment, cap 18 includes a fill seal 68 surrounding second opening 16. In one embodiment fill seal 68 is comprised of an elastomeric material. In one embodiment, fill seal 68 is configured to prevent liquid from entering between second cover 30 and cap 18. In one embodiment, fill seal 68 forms a seal with the interior surface of second cover 30 to close second opening 16 in the storage position. In one embodiment, fill seal 68 forms a seal with the interior surface of second cover 30 extending around the perimeter of window 50 in the fill position. In one embodiment, cap 18 includes a fill vent 72 in fluid communication with vent 36. In one embodiment, second cover 30 includes a vent groove 70 that is in fluid communication with fill vent 72 in the fill position. In one embodiment, vent groove 70 and fill vent 72 are configured to fluidly couple the interior of bottle 12 with the ambient air so that air within bottle 12 can vent to atmosphere as the bottle 12 is filled with water. In one embodiment, the air within bottle 12 vents through vent groove 70 and out between the second cover 30 and the first cover 28 during filing even if first cover 28 has closed vent 36. In one embodiment, fill seal 68 extends around fill vent 72.

Figure 10:
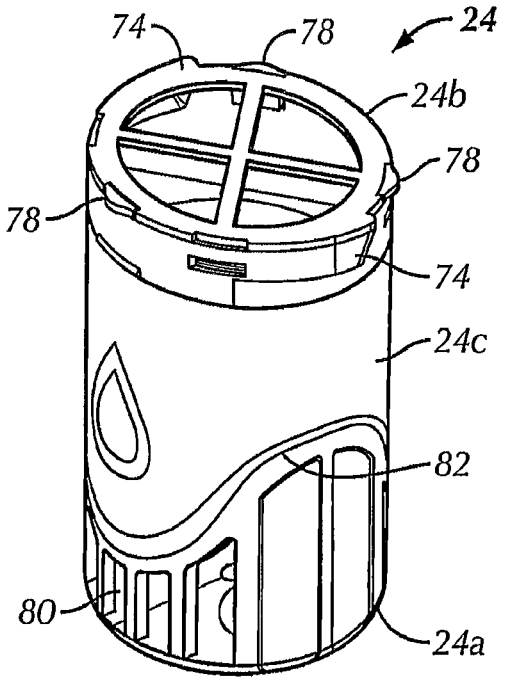
FIG. 10 is a perspective view of a filter of the water bottle shown in FIG. 1.

Referring to FIGS. 8 and 10, in one embodiment, cap 18 includes a filter 24. In one embodiment, filter 24 is configured to filter out particulates and chemicals from the incoming water. In one embodiment, filter 24 includes activated carbon. In one embodiment, filter 24 is a fast flow filter. In one embodiment, filter 24 is configured to reduce at least one contaminant conforming to the NSF/ANSI 42 standard at a given flow rate of at least 0.5 Lpm while filing bottle 12 through second opening 16. In one embodiment, filter 24 is configured to reduce at least one contaminant conforming to the NSF/ANSI 42 standard at a given flow rate of approximately 1.9 Lpm to approximately 2.3 Lpm while filing bottle 12 through second opening 16. In one embodiment, filter 24 is configured to reduce at least one contaminant conforming to the NSF/ANSI 42 standard at a given flow rate of at least 0.5 Lpm while filing bottle 12 through the top of cap 18. In one embodiment, the filter is configured to reduce at least one contaminant conforming to the NSF/ANSI 42 standard at a given flow rate of approximately 1.9 Lpm to approximately 2.3 Lpm while filing bottle 12 through the top of cap 18. In one embodiment, filter 24 is similar to the filters disclosed in U.S. Patent Application Publication No. 2012/0055862 which is hereby incorporated by reference herein in its entirety.

In one embodiment, filter 24 is coupled to cap 18 and extends into bottle 12. In one embodiment, filter 24 is removably coupled to cap 18. In one embodiment, filter 24 is keyed to cap 18 so that filter 24 may only be coupled to cap 18 in one configuration. In one embodiment, filter 24 includes one or more projections 74 configured to engage with one or more indents 76 in cap 18. In one embodiment, a top 24*b* is configured to be opened or removed from the remainder of filter 24 in order to replace the filter media. In one embodiment, top 24*b* includes tabs 78 used to release top 24*b*. In one embodiment, tabs 78, similar to or in place of projections 74, are keyed with corresponding indents 76 in cap 18.

Referring to FIG. 10, in one embodiment, filter 24 has at least one opening on top 24*b* for receiving incoming water to be filtered and has one or more openings 80 for dispending filtered water into bottle 12. In one embodiment, one or more openings 80 extend through a sidewall 24*c* proximate bottom 24*a* of filter 24. In one embodiment, filter 24 is closed except for top 24*b* and openings 80. In one embodiment, bottom 24*a* is closed. In one embodiment, openings 80 (e.g., the outlet of filter 24) are generally orthogonal to top 26*b* (e.g., the inlet of filter 24). In other embodiments, openings 80 are radially spaced around the perimeter of sidewall 24 and/or extend through bottom 24*a*. In one embodiment, filter 24 includes indicia 82 for measuring the filtered water in bottle 12 as discussed further below.

Referring to FIG. 6, in one embodiment, cap 18 forms a reservoir 84. In one embodiment, cap 18 is configured to allow water to completely fill reservoir 84 when apparatus 10 is horizontal. In one embodiment, reservoir 84 is configured to contain unfiltered water entering second opening 16 and before going through filter 24. In one embodiment, unfiltered water may enter second opening 16 faster than filter 24 can filter the water. In one embodiment, some unfiltered water may remain in reservoir after apparatus 10 is in the storage position.

Figure 4:
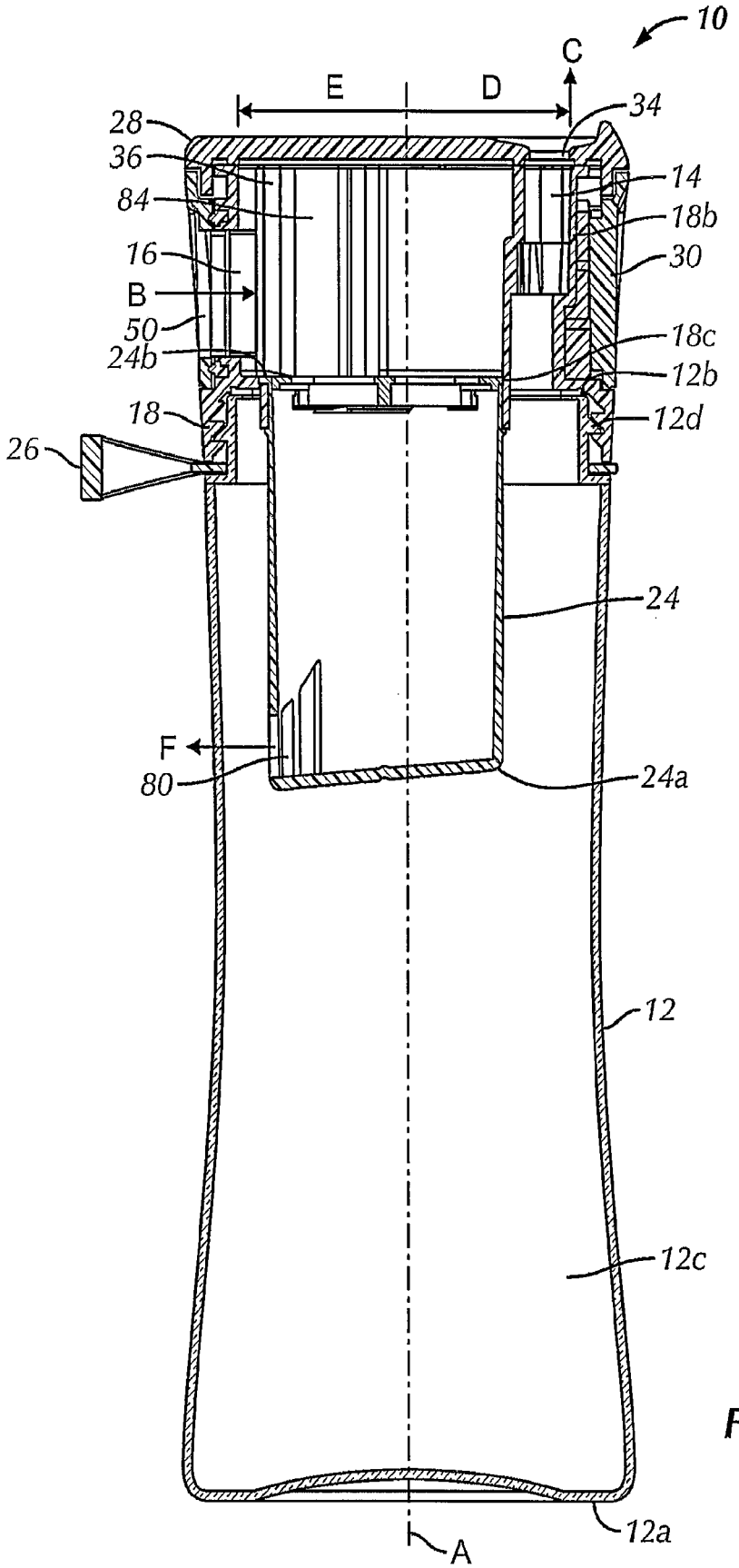
FIG. 4 is a cross sectional side view of the water bottle shown in FIG. 2B taken about line 4-4.

Referring to FIG. 4, in one embodiment, first opening 14 is open (e.g., dispenses liquid from bottle 12) in a direction C generally parallel with longitudinal axis A in the pour position and first cover 28 is configured to close or seal first opening 14 (e.g., prevents dispending liquid from bottle 12 through first opening 14) in the closed position. In one embodiment, second opening 16 is open (e.g., receives liquid into bottle 12) in a direction B generally orthogonal with longitudinal axis A in the fill position and second over 30 is configured to close or seal second opening 16 (e.g., not receive liquid into bottle 12 through second opening 16) in the storage position. In one embodiment, first opening 14 is an opening on the top of apparatus 10. In one embodiment, first opening is an opening on the top of cap 18. In one embodiment, second opening 16 is an opening on the side of apparatus 10. In one embodiment, second opening 16 is an opening in sidewall 18*c* of cap 18. In one embodiment, first opening 14 is axially spaced from longitudinal axis A a distance and direction D. In one embodiment, second opening 16 is axially spaced from longitudinal axis A a distance and direction E. In one embodiment, first opening 14 is generally diametrically opposed with second opening 16 with respect to longitudinal axis A. In one embodiment, openings 80 in filter 24 open in a direction F. In one embodiment, direction F is generally opposite to direction D so that first opening 14 is generally diametrically opposed to openings 80 in filter 24. In one embodiment, second opening 16, openings 80 in filter 24 and vent 36 are all generally on the same side of apparatus 10.

Figure 3:
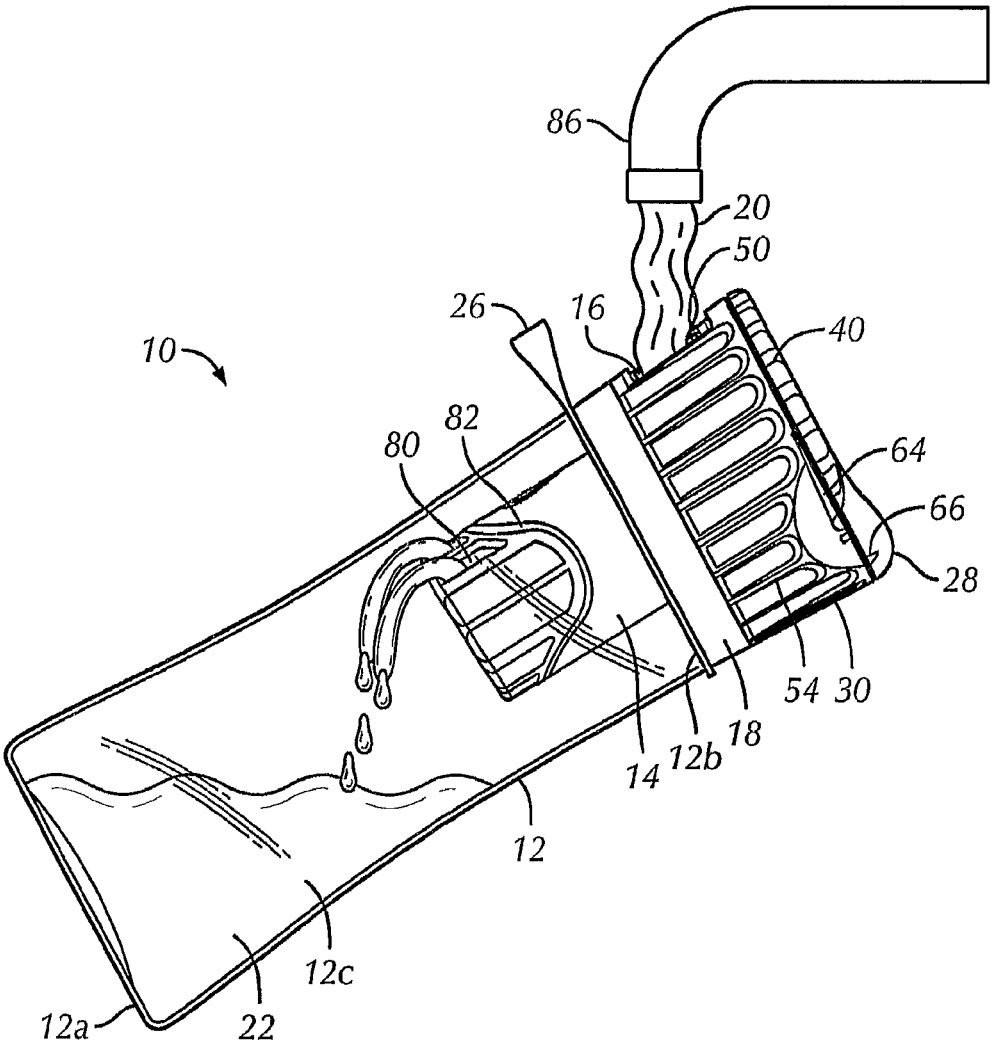
FIG. 3 is a side view of the water bottle shown in FIG. 2B being filled.

Referring to FIGS. 3 and 4, in an exemplary use, first cover 28 is placed into the closed position by aligning indicia 64, 66. Second cover 30 is then placed into the fill position. In one embodiment, window 50 is aligned with second opening 16 to expose second opening 16 in the fill position. In one embodiment, apparatus 10 is tilted under a water source 86 such that water 20 enters second opening 16. In one embodiment, apparatus 10 is tilted to be generally horizontal while filling. In one embodiment, apparatus 10 is tilted during filling such that bottom 12*a* is slightly lower than cap 18. In one embodiment, apparatus 10 is tilted during filling to be approximately 5 degrees to approximately 25 degrees relative to horizontal with bottom 12*a* being vertically lower than cap 18. In one embodiment, water 20 enters reservoir 84 and begins to flow through filer 24 and into bottle 12. In one embodiment, if unfiltered water 20 entering second opening 16 is more than the amount of filtered water 22 entering bottle 12, unfiltered water 20 will collect in reservoir 84. In one embodiment, the air within bottle 12 is vented out through a third opening or vent 36 that extends through cap 18 but bypasses reservoir 84. In one embodiment, the user can watch the filtered water 22 fill in the bottle through the transparent bottle 12. In one embodiment, the user can align the top of the water within bottle with indicia 82 on filter so that apparatus 10 is not over filled. In one embodiment, once the top of filtered water 22 reaches indicia 82 or another desired amount, the user positions second cover 30 into the storage position to close second opening 16. In one embodiment, user can set apparatus 10 down or otherwise position apparatus 10 in a vertical position. In one embodiment, any water remaining in reservoir 84 will continue to filter down into bottle 12. In one embodiment, bottom 24*a* of filter 24 is at an oblique angle with respect to longitudinal axis A in order to drain any water within filter 24 into bottle 12.

Referring to FIG. 4, in one embodiment, when the user is ready to drink from apparatus 10, first cover 28 is positioned in the open position to open or expose first opening 14. In one embodiment, the user tilts the bottom 12*a* of bottle 12 up to pour the filtered water 22 within bottle 12 out of first opening 14. In one embodiment, first opening 14 is a channel or tube that extends through cap 18. In one embodiment, first opening 14 bypasses reservoir 84. In one embodiment, first opening 14 is only fluidly coupled to reservoir 84 in the storage position through filter 24. In one embodiment, openings 80 are positioned on the opposite side of first opening 14 and configured such that the amount of water 22 filtered back through filter 24 and into reservoir 84 during pouring of water 22 from first opening 14 is reduced. In one embodiment, ambient air flows back into bottle 12 through vent 36 as filtered water 22 is poured through first opening 14. In one embodiment, after pouring the filtered water 22 from first opening 14, the user can store the remaining filtered water 22 in bottle 12 by closing first opening 14 and vent 36.

Apparatus 10 may have additional configurations to achieve similar functions as the embodiments above. For example, second opening 16 may be positioned proximate bottom 12*a* of bottle 12 while first opening 14 is positioned proximate top 12*b* of bottle 12. In such an example, bottom 12*a* of bottle 12 may be opened similar to top 12*b* of bottle 12. In another embodiment, reservoir 84 and filter 24 may be contained within a cartridge proximate bottom 12*a* and opened via a locking sliding window. In another embodiment, second cover 30 may slid in the axial direction to open and close second opening 16.

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. Unless specifically set forth herein, the terms "a", "an" and "the" are not limited to one element but instead should be read as meaning "at least one".

We claim:

1. A portable, personal apparatus for transporting liquid comprising:

a bottle configured to contain liquid, the bottle having a longitudinal axis;

a first opening open in a pour position;

a first cover coupled to the bottle and configured to close the first opening in a closed position;

a second opening open in a fill position;

a second cover coupled to the bottle and configured to close the second opening in a storage position, the second cover remaining coupled to the bottle when the second cover is in the fill position;

a vent configured to fluidly couple an interior of the apparatus with ambient air;

a filter extending into the bottle; and a cap configured to be coupled to the bottle, wherein the cap includes a fluid reservoir between the filter and at least one of the first and second openings.

2. The apparatus of claim 1, wherein the bottle has a closed bottom and an open top, the bottle further comprising:

a cap coupled to the open top of the bottle, the cap including the first opening and the second opening.

3. The apparatus of claim 2, wherein the filter is coupled to the cap and extends into the bottle.

4. The apparatus of claim 3, wherein the filter includes a closed bottom surface, the bottom surface being at an oblique angle with respect to the longitudinal axis.

5. The apparatus of claim 3, wherein the first opening is spaced from the longitudinal axis in a first direction and wherein the filter is closed except for a top surface and at least one sidewall opening, the at least one sidewall opening facing in a second direction generally opposite the first direction.

6. The apparatus of claim 3, wherein an inlet of the filter is generally orthogonal to an outlet of the filter.

7. The apparatus of claim 2, wherein the cap includes a sidewall and an open top, the second opening extends through the sidewall and the first cover is coupled to the open top of the cap.

8. The apparatus of claim 7, wherein the second cover is a collar having a window, the collar extending around the sidewall of the cap and configured to be selectively rotated with respect to the cap about the longitudinal axis, the window aligning with the second opening in the fill position.

9. The apparatus of claim 2, wherein the cap is threadably coupled to the bottle.

10. The apparatus of claim 1, wherein the first opening is only in fluid communication with the fluid reservoir in the storage position through the filter.

11. The apparatus of claim 1 further comprising:

a third opening configured to allow ambient air into the bottle when liquid is poured from the first opening.

12. The apparatus of claim 11, wherein the third opening is closed when the first cover is in the closed position.

13. The apparatus of claim 1, wherein the first opening is spaced from the longitudinal axis and is generally diametrically opposed to the second opening with respect to the longitudinal axis.

14. The apparatus of claim 1, wherein the second cover is a collar configured to be selectively rotated about the longitudinal axis.

15. The apparatus of claim 1, wherein the first cover is a top cap configured to be selectively rotated about the longitudinal axis.

16. The apparatus of claim 1, wherein the first cover remains coupled to the bottle when the first cover is in the pour position.

17. A portable, personal apparatus for transporting liquid comprising:

a bottle configured to contain liquid, the bottle having a longitudinal axis;

a first opening open in a pour position, wherein the first opening is spaced from the longitudinal axis;

a first cover coupled to the bottle and configured to close the first opening in a closed position;

a second opening open in a fill position, wherein the first opening is generally diametrically opposed to the second opening with respect to the longitudinal axis;

a second cover coupled to the bottle and configured to close the second opening in a storage position, the second cover remaining coupled to the bottle when the second cover is in the fill position;

a vent configured to fluidly couple an interior of the apparatus with ambient air; and a filter extending into the bottle.

18. The apparatus of claim 17, wherein the filter is coupled to a cap, wherein the cap includes a fluid reservoir between the second opening and the filter.

19. The apparatus of claim 18, wherein the vent comprises an opening at a top surface of the cap, the opening configured to be closer to a sidewall of the cap than the center of the cap.

* * * * *